United States Patent [19]

Shirose et al.

[11] Patent Number: 4,514,486

[45] Date of Patent: Apr. 30, 1985

[54] METHOD FOR THE FORMATION OF IMAGES

[75] Inventors: Meizo Shirose, Hino; Kunio Ito, Tama; Hiroyuki Takagiwa; Jiro Takahashi, both of Hachioji; Kouichi Gunzi, Hino, all of Japan

[73] Assignee: Konishiroku Photo Industry Co., Ltd., Tokyo, Japan

[21] Appl. No.: 526,812

[22] Filed: Aug. 26, 1983

[30] Foreign Application Priority Data

Aug. 30, 1982 [JP] Japan ..... 57-149053

[51] Int. Cl.[3] ..... G03G 5/38

[52] U.S. Cl. ..... 430/124; 355/3 FU; 219/216; 432/60; 432/228

[58] Field of Search ..... 430/124; 355/3 FU; 432/60; 219/216, 469

[56] References Cited

U.S. PATENT DOCUMENTS 4,019,024 4/1977 Namiki ..... 432/288 X 4,234,248 11/1980 Beck ..... 432/60 X

*Primary Examiner*—John D. Welsh

*Attorney, Agent, or Firm*—Finnegan, Henderson, Farabow, Garrett, and Dunner

[57] ABSTRACT

In a method for the formation of images such as an electrophotographic method in which toners are used, when a heat roller is used for fixing toner images, the durability and the heat efficiency of the heat roller is improved reducing the wall thickness of the cylindrical metal of the heat roller, shortening the warming-up time, using a material having a substantial Young's modulus, and by shortening the outer diameter of the cylindrical metal, respectively.

With respect to toners specifically used for the above, stains on an image carrier are prevented by making use of a binder that is fused at a heating temperature of the heat-fixing roller and is increased in the elasticity of the toner at the same temperature or higher. Such binders may be obtained by copolymerizing a polyhydric alcohol and/or a polyhydric amine, and a polyhydric carboxylic acid.

11 Claims, 1 Drawing Figure

METHOD FOR THE FORMATION OF IMAGES

BACKGROUND OF THE INVENTION

1. Field of the Invention

The present invention relates to a method for the formation of images which visualizes an electrostatic or magnetic latent image, or the like, by use of a toner to form a toner image, which toner image is then transferred onto a transfer paper to thereby obtain a final image.

2. Description of the State of the Art

Heretofore, in a method for the formation of an image, for example, in an electrophotographic method, there comprises a process of forming an electrostatic image on a photoreceptor drum, a developing process of visualizing the electrostatic image to produce a toner image, and a fixing process of fixing the toner image. In the fixing process, the toner image that has been formed in the developing process, although it can, as it is, be fixed onto the support, in most cases, is transferred onto another support, and the transferred toner image is then fixed.

For the fixation of the toner image there are known various methods, among which, particularly, the contact-heat fixing method which uses heat rollers is excellent in its high thermal efficiency with the capability of a rapid fixing, so that it is suitable for the fixation in a high-speed copier. Besides, because a relatively low temperature heat source is used, the power consumption can be reduced, thus enabling the design of the copier to be compact and energy saving. Further, in case a paper stays jammed inside the fixing section, there is no possible danger of catching fire, so that the method is favorable also in this respect.

This method, however, has a problem in that it produces "offset phenomenon," the phenomenon being such that part of the toner of a toner image is transferred during fixation onto the surface of a heat roller, which is then retransferred onto the incoming transfer paper to stain the image thereon. In order to prevent the offset phenomenon there may be effectively used such means that a heat roller is provided adjacently thereto with a cleaning member such as a cleaning roller which is to clean the heat roller by removing the toner attached to the roller.

However, in the case where such a cleaning member is provided, the so-called back-staining phenomenon begins to appear. The back-staining phenomenon is such that when the toner material deposited on the cleaning member is subjected to an excessive amount of heat, the toner material is transferred to a pressure roller being pressed against a heat roller. The toner material on the pressure roller thus stains the back of the support such as transfer paper or the like incoming to the position thereafter, and further the toner material is transferred to the heat roller to cause a stain on the support.

On the other hand, the heat fixing method which uses heat rollers requires warming up time before starting the use of the apparatus. The heat roller used herein is composed usually of a metallic cylinder coated therearound with a layer such as a layer of Teflon resin. Conventionally, a heat cylinder composed of an aluminum cylinder has been used for fixing, whose cylinder wall thickness is 4 mm for technical reasons, so that it requires a long warming-up time, e.g., 90 seconds. On the other hand, an effective way for shortening the warming-up time is to reduce the wall thickness of the heat roller. In order to reduce the thickness of the cylinder wall and yet to make it so durable in the structural strength, material having a high Young's modulus such as carbon steel, chromium steel, stainless steel, or the like, needs to be used. However, in the heat roller cylinder made of such a material, the heat conductivity of the material is so small that the entire material is hardly uniformly heated, and the heat roller cylinder is sometimes excessively heated locally when the heat thereon is not lowered by a transfer paper or the like, and thus causing the back-staining phenonmenon.

SUMMARY OF THE INVENTION

The present invention has been made in view of this situation, and an object of the present invention is to provide a method for the formation of images, whose warming-up time is short, which produces no back-staining phenomenon, and which is capable of positively effecting a satisfactory fixing operation. The present invention comprises a process of thermally fixing a toner image by use of a fixing means having a heat roller whose cylindrical wall's thickness is not more than 2 mm, the toner image being formed by use of a toner which melts at a given heating temperature of the fixing means and whose elasticity increases with time, and the toner image being thermally fixed by the fixing means.

DETAILED DESCRIPTION OF THE INVENTION

Figure 1:
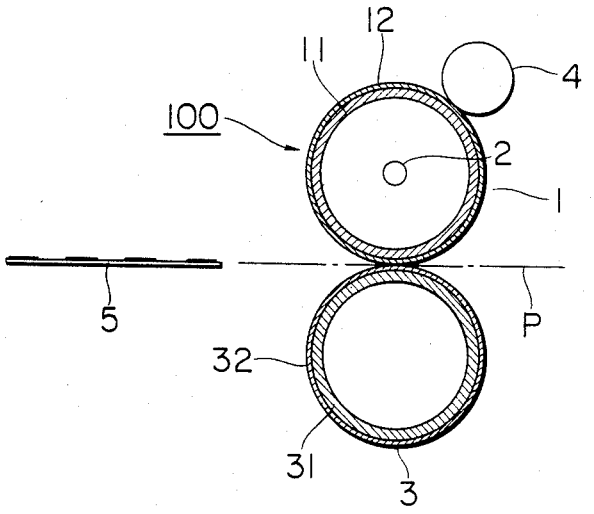
FIG. 1 is a cross-sectional view of a fixing means including a heat roller relating to the invention, taken on a line which is orthogonal to the heat roller shaft.

In the invention an invisible latent image pattern is formed on an image pattern carrier by means of a latent image former which attracts toners electrically or magnetically, and the invisible latent image is made visible with toners by means of a developer. Further, in general, the visualized toner image is transferred onto an image carrier such as a transfer paper and is then transferred to a fixer to be applied thereto a heat-fixing process.

In the present invention, as shown in FIG. 1, a fixing device 100 is used which is composed of a heat roller 1 having a cylindrical metal 11 coated therearound with a layer 12 of for example Teflon resin or a silicone resin. A heater 2 is arranged inside the internal space of heat roller and 1, a pressure roller 3 having a cylindrical metal 31 is formed therearound with a silicone layer 31 arranged juxtaposedly so as to press upon heat roller 1. A cleaning roller 4 is arranged opposite to and in contact with heat roller 1. A toner image is formed on a transfer paper 5 through, e.g., a photoreceptor drum with a toner which melts at a heating temperature set in the above fixing device 100 and whose elasticity becomes increasing with time at the same temperature. Transfer paper 5, having an image formed thereon, is then transported along a path P to pass through the contact region between heat roller 1 and pressure roller 3, and the toner becomes molten from the heat of heat roller 1 and is thereby softened. As a result the toner image is fixed onto the transfer paper.

In the present invention, the wall thickness of cylindrical metal 11 of heat roller 1 needs to be not more than 2 mm, preferably not more than 1.5 mm, and more preferably not more than 1.0 mm, and it is desirable that the outer diameter of cylindrical metal 11 is made as small as possible preferably, between about 50 to 20 mm. It is desirable that the material of cylindrical metal 11 have a Young's modulus of not less than $1.2\times10^4$ kg/mm$^2$, and more preferably of not less than $1.6\times10^4$ kg/mm$^2$. Examples of such metals include carbon steel, chromium steel, stainless steel, or the like.

And in the present invention, because the wall thickness of cylindrical metal 11 of heat roller 1 is specified to be not more than 2 mm, the warming-up time is short without any substantial influence of the material of cylindrical metal 11. By reason of the wall thickness of cylindrical metal 11 being not more than 2 mm, as the material for cylindrical metal 11 it is advantageous for the reason of its strength to use one that has a large Young's modulus. Such a material has a small heat conductivity, so that the both ends of the roller and the like, as the cylindrical metal, can be excessively heated locally. The toner to be used in the present invention, after becoming molten at a given temperature, becomes increasingly elastic with time at the same temperature, so that the toner, at the time when just contacted with heat roller 1 to become molten, is still so little elastic and so wet as to be able to sufficiently permeate into the fiber of a transfer paper, and therefore a positively satisfactory fixation is carried out. On the other hand, part of the toner material that remains on heat roller 1 is then cleaned out by cleaning roller 4 thereby to be deposited on cleaning roller 4, which deposited toner material becomes increasingly elastic with time on cleaning roller 4. Accordingly the toner material, even if heated to a temperature much higher than the temperature set in heat roller 1, will not be transferred onto pressure roller 3, thus resulting in no back-staining phenomenon.

In order to provide the toner material, after being molten at the set heating temperature, with a nature of economically increasing its elasticity, there should be used as the binder for the toner such a polymer material as, for example, a thermal polymerization type polymer having an unreacted functional group still to be thermally polymerization-reacted remaining therein. For example, there should be used as the binder such a polymer as having an elasticity of 1000 to 20000 dyne/cm$^2$ immediately after becoming molten, and then having, after being held for 60 minutes under a temperature condition 10° to 60° C. higher than the initially set heating temperature, having an increased elasticity to not less than double, and preferably to not less than 4 times the initial elasticity; to as much increased an elasticity as possible—exceeding 24000 dyne/cm$^2$.

The above-mentioned elasticity is a dynamic elasticity modulus obtained through the measurement of dynamic viscoelasticity performed by use of a cone-and-plate viscometer "Shimazu Rheometer RM-1" (manufactured by Shimazu Seisakusho, Ltd.). The method for the measurement and the analytical theory thereof are detailed in the "Measurement Methods in Rheology" (edited by the Rheology Committee of the Society of Polymer Science, Japan) and in the "Instruction Manual for Shimazu Rheometer RM-1 for use in the measurement of steady current viscosity-dynamic viscoelasticity. A sample to be measured (viscoelastic object) is subjected to a sine shear transformation, and the shear stress having an equal periodicity thereto is measured to thereby obtain a dynamic elasticity modulus. The measurement of the dynamic elasticity modulus by this method is affected by the shear rate, i.e., the number of revolution of the disc, and the number of revolution was set to 50 r.p.m.

As the binder of the above-mentioned toner, there may be used as preferred ones those polyester resins obtained by the copolymerization of polyhydric carboxylic acids with polyhydric alcohols, polyamide resins obtained by the condensation of polyhydric carboxylic acids with polyhydric amines, and the like. Particularly preferred are those in which a polyvalent monomer which is not less than a trivalent monomer is contained in the binder in a proportion of from at least 15 to 40 mole % to all of the monomers in the copolymerization. And those preferred in the case of using a polyester resin as the binder are such polyesters as having an acid value of not less than 27, preferably not less than 30, and more preferably not less than 37.

Examples of dicarboxylic acids suitably usable for obtaining polyester resins or polyamide resins are, for example, maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, acid anhydrides of these acids, dimers of lower alkyl esters with linolenic acid, and the like.

Examples of suitably usable polyhydric (not less than trihydric) carboxylic acids include, e.g., 1,2,4-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxyl-propane, tetra(methylenecarboxyl)methane, 1,2,7,8-octanetetracarboxylic acid, and acid anhydrides of these acids, and the like.

Examples of those polyhydric alcohols capable of being condensed with the above polyhydric carboxylic acids to produce polyester resins include, e.g., such diols as ethylene glycol, diethylene glycol, triethylene glycol, 1,2-propylene glycol, 1,3-propylene glycol, 1,4-butanediol, neopentyl glycol, 1,4-butanediol, etc., such etherified bisphenols as 1,4-bis(hydroxymethyl) cyclohexane, bisphenol A, hydrogenated bisphenol A, polyoxyethylenated bisphenol A, polyoxypropylenated bisphenol A, etc., and the like. Examples of those suitably usable polyhydric (not less than trihydric) alcohols include, e.g., sorbitol, 1,2,3,6-hexanetetrol, 1,4-sorbitan, pentaerythritol, dipentaerythritol, tripentaerythritol, sugar, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and the like.

Further, examples of those polyhydric amines capable of being condensed with the above polyhydric carboxylic acids to produce polyamide resins include, e.g., ethylenediamine, hexamethylenediamine, iminobispropylamine, phenylenediamine, xylenediamine, 4,4'-diaminophenylether, diethylenetriamine, triethylenetetramine, and the like.

The cleaning member for use in cleaning the surface of heat roller 1 may be in the form of a roller, blade, pad, or the like.

Examples of the present invention are illustrated below, but the present invention is not limited thereto.

In addition, the term "part(s)" used hereinafter represents "part(s) by weight."

EXAMPLE 1

A mixture of 91 g of terephthalic acid, 490 g of polyoxypropylenated bisphenol and 200 g of polyoxyethylenated bisphenol A was heated under a nitrogen gas flow, and to this mixture was added 0.05 g of tin dibutyloxide to react therewith at a temperature kept at 200° C., and after that, 161 g of 1,2,4-benzenetricarboxylic anhydride was added to it to continue the reaction. The proceeding of the reaction was traced according to the softening point by use of a Koka flow tester, and the reaction was stopped when the softening point of the produced polymer reached 132° C., and then the reaction system was cooled to room temperature, thereby synthesizing resin A. The thus produced resin A was dissolved into dioxane and subjected to a titration which was made by use of an alcoholic potassium hydroxide solution with phenolphthalein as an indicator, and the acid value of resin A was measured according to the mg value of the potassium hydroxide necessary to neutralize 1 g of the resin. The result of the measurement was 37. 100 parts of the obtained resin A, 10 parts of carbon black and 3 parts of polypropylene "Viscol 660P" (manufactured by Sanyo Chemical Industry Co., Ltd.) were mixed and kneaded with heating to 125° C. by means of an extruder, and then the mixture was cooled, pulverized and classified as in the ordinary manner of producing a toner. The softening point of the toner was 127° C. This was regarded as "Toner-1."

The elasticity of Toner-1 measured by use of a Shimazu Rheometer RM-1 was 2300 dyne/cm$^2$ at 190° C. The measurement made after allowing the toner to stand for 60 minutes at 210° C. showed 80,000 dyne/cm$^2$; the elasticity was increased to 35-fold value. The minimum fixable temperature was 150° C. 5 parts of Toner-1 and 95 parts of iron powder were mixed to prepare a developer.

Next, a modified model of an electrophotographic copier U-Bix V (manufactured by Konishiroku Photo Industry Co., Ltd.) was equipped with a fixing device composed of a carbon-steel heat roller with its outer diameter of 30 mm and its wall thickness of 1.0 mm, coated therearound with a 30$\mu$-thick Teflon layer. A heater of power consumption of 1,300 W was arranged inside the internal space of the heat roller, and a pressure roller with a coat of a silicone rubber KE-1300RTV was formed therearound. A cleaning roller with a coat of an aromatic nylon nonwoven fabric "Nomex" (produced by DuPont) therearound was used with the temperature of the heat roller set to 190° C. to measure the warming-up time of the electrophotographic copier, and after that a 10000-copy making running test was made with use of the above-mentioned developer. The results of the tests are as shown in the table given hereinafter.

EXAMPLE 2

A warming-up time measurement was made in the same manner as in Example 1 with the exception that a 1.5 mm-thick wall-having carbon steel cylinder was used as the heat roller of the fixing device, and the measurement was followed by a 10000-copy making running test. The results obtained are as shown in the table.

EXAMPLE 3

A warming-up time measurement was made in the same manner as in Example 1 with the exception that a 2.0 mm-thick wall-having carbon steel cylinder was used as the heat roller of the fixing device, and the measurement was followed by a 10000-copy making running test. The results obtained are as shown in the table.

EXAMPLE 4

A warming-up time measurement was made in the same manner as in Example 1 with the exception that a 1.0 mm-thick wall-having nickel steel cylinder was used as the heat roller of the fixing device, and the measurement was followed by a 10000-copy making running test. The results obtained are as shown in the table.

EXAMPLE 5

A warming-up time measurement was made in the same manner as in Example 1 with the exception that a 1.0 mm-thick wall-having chromium steel cylinder was used as the heat roller of the fixing device, and the measurement was followed by a 10000-copy making running test. The results obtained are as shown in the table.

EXAMPLE 6

A warming-up time measurement was made in the same manner as in Example 1 with the exception that a 1.0 mm-thick wall-having 18-8 stainless steel cylinder was used as the heat roller of the fixing device, and the measurement was followed by a 10000-copy making running test. The results obtained are as shown in the table.

COMPARATIVE EXAMPLE 1

A warming-up time measurement was made in the same manner as in Example 1 with the exception that a 2.5 mm-thick wall-having carbon steel cylinder was used as the heat roller of the fixing device, and the measurement was followed by a 10000-copy making running test. The results obtained are as shown in the table.

COMPARATIVE EXAMPLE 2

A warming-up time measurement was made in the same manner as in Example 1 with the exception that a 2.5 mm-thick wall-having chromium steel cylinder was used as the heat roller of the fixing device, and the measurement was followed by a 10000-copy making running test. The results obtained are as shown in the table.

COMPARATIVE EXAMPLE 3

A toner was prepared in the same manner as in Example 1 with the exception that a styrene-methyl methacrylate-butyl methacrylate copolymer (the proportion by weight of the styrene, methyl methacrylate, and butyl methacrylate is 5:2:3, the weight average molecular weight Mw is 97000, the ratio Mw/Mn of the weight Mn is 10.2, and the softening point is 130° C.) was used in place of the resin A in Example 1. This toner obtained herein was regarded as Toner-2.

Toner-2 was measured for its elasticity by use of a Shimazu Rheometer RM-1, then the immediate result was 4100 dyne/cm$^2$ at 190° C., and even after allowing it to stand for 60 minutes at 210° C. the result was 4000 dyne/cm$^2$ with no increase in the elasticity.

A warming-up time measurement was made in the same manner as in Example 1 with the exception that Toner-2 was used in place of the Toner-1 in Example 1, and after that a 10000-copy making running test was performed. The obtained results are as shown in the table.

TABLE

| | Cylinder wall thickness (mm) | Material of roller cylinder | Toner | Warming-up time (sec) | Back-staining phenomenon |
|---|---|---|---|---|---|
| Example-1 | 1.0 | Carbon steel | Toner-1 | 30 | none |
| Example-2 | 1.5 | Carbon steel | Toner-1 | 45 | none |
| Example-3 | 2.0 | Carbon steel | Toner-1 | 58 | none |
| Example-4 | 1.0 | Nickel steel | Toner-1 | 45 | none |
| Example-5 | 1.0 | Chromium steel | Toner-1 | 47 | none |
| Example-6 | 1.0 | ST steel* | Toner-1 | 45 | none |
| Comparative-1 | 2.5 | Carbon steel | Toner-1 | 70 | none |
| Comparative-2 | 2.5 | Chromium steel | Toner-1 | 74 | none |
| Comparative-3 | 1.0 | Carbon steel | Toner-2 | 30 | present |

Note
*"ST steel" represents 18-8 stainless steel.

As has been described, the present invention provides a method for the formation of images which is capable of reducing warming-up time and of effecting positively satisfactory fixation without causing any back-staining phenomenon.

What is claimed is:

1. A method for the formation of images comprising the step of thermally fixing a toner image with the use of a fixing device having a heat roller, wherein said heat roller is of a cylindrical metal whose wall thickness is not more than 2 mm, said fixing of said toner image being made with the use of a toner which melts at a prescribed temperature for said fixing device and which becomes increasingly elastic with time.

2. The method for the formation of images as claimed in claim 1, wherein the cylindrical metal of said heat roller is of a material having a Young's modulus of not less than $1.2\times10^4$ kg/mm$^2$.

3. The method for the formation of images as claimed in claim 1, wherein the outer diameter of the cylindrical metal of said heat roller is from 20 to 50 mm.

4. The method for the formation of images as claimed in claim 1, wherein the binder of said toner is a copolymer comprising at least one monomer selected from a group of a polyhydric alcohol and a polyhydric amine and at least one monomer selected from a group of polyhydric carboxylic acids.

5. The method for the formation of images as claimed in claim 4, wherein, 15 to 40 mole % of the monomers selected respectively from said polyhydric alcohols, polyhydric amines and polyhydric carboxylic acids, are polyhydric monomers which are not less than trihydric monomers.

6. The method for the formation of images as claimed in claim 4 or 5, wherein, as the binders for said toners, a copolymer is used so as to give said toners an elasticity of 1,000 to 20,000 dyne/cm$^2$ immediately after becoming molten at said prescribed heating temperature and further to give said toners an elasticity of not less than 24,000 dyne/cm$^2$ after being held for 60 minutes under a temperature condition 10° to 60° C. higher than said prescribed heating temperature.

7. In a method for the fixing of a toner image comprising the step of thermally fixing a toner image by bringing said toner image into pressure contact with a heat roller, the improvement which comprises a heat roller comprising a cylindrical metal having a wall thickness of not more than 2 mm and being made of a metal whose Young's modulus is not more than $1.2\times10^4$ kg/mm$^2$ and said toner becoming increasingly elastic with the lapse of time once melted at a prescribed temperature applied to said toner.

8. The method according to claim 7, wherein said toner comprises a binder resin having an eleasticity of 1000 to 20000 dyne/cm$^2$ immediately after being melted by heat and increasing its elasticity by more than twice as much compared to immediately after melting when said resin is kept for one hour at a temperature of from 10° to 60° C. higher than the temperature immediately after melting.

9. The method according to claim 8, wherein said binder resin is a polyester resin obtained by a condensation reaction of a polyvalent carboxylic acid and a polyhydric alcohol or a polyamide resin obtained by a condensation reaction of a polyvalent carboxylic acid and a polyhydric alcohol.

10. The method according to claim 9, wherein said metal is selected from a group consisting of carbon steel, chromium steel and stainless steel.

11. The method according to claim 10, wherein the surface of said cylindrical metal is coated with a silicone resin or a fluorinated vinyl polymer resin.

* * * * *

UNITED STATES PATENT AND TRADEMARK OFFICE

CERTIFICATE OF CORRECTION

PATENT NO. : 4,514,486

DATED : April 30, 1985

INVENTOR(S) : Meizo Shirose et al.

It is certified that error appears in the above—identified patent and that said Letters Patent is hereby corrected as shown below:

IN THE ABSTRACT:

Line 5, after "improved" insert --by--;

Line 8, after "and" delete "by".

IN THE CLAIMS:

Claim 8, Line 2, change "eleasticity" to --elasticity--;

Line 6, after "said" insert --binder--; and

Line 7, should be part of the preceeding paragraph and should not begin a new paragraph.

Signed and Sealed this

*Thirteenth* Day of *August 1985*

[SEAL]

*Attest:*

DONALD J. QUIGG

*Attesting Officer* *Acting Commissioner of Patents and Trademarks*